US007744413B2

(12) United States Patent
Ma

(10) Patent No.: US 7,744,413 B2
(45) Date of Patent: Jun. 29, 2010

(54) METAL MODULE HOUSING FOR MOUNTING ON A PRINTED CIRCUIT BOARD

(75) Inventor: Wen-Qiang Ma, ShenZhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/218,733

(22) Filed: Jul. 16, 2008

(65) Prior Publication Data

US 2009/0023348 A1 Jan. 22, 2009

(30) Foreign Application Priority Data

Jul. 16, 2007 (TW) ..... 96211530 U

(51) Int. Cl.
*H01R 13/648* (2006.01)

(52) U.S. Cl. ..... 439/607.01; 439/607.55

(58) Field of Classification Search ..... 439/834, 439/497, 607.01, 607.55
See application file for complete search history.

(56) References Cited

U.S. PATENT DOCUMENTS 4,660,917 A * 4/1987 DeRoss et al. ..... 439/404
6,113,428 A * 9/2000 Yeh ..... 439/607.17
7,435,140 B2 * 10/2008 Wang ..... 439/607.01
7,467,974 B2 * 12/2008 Zhang ..... 439/607.01
2003/0218873 A1 * 11/2003 Eromaki et al. ..... 361/816
2006/0121756 A1 * 6/2006 Kuo et al. ..... 439/76.1
2007/0238357 A1 * 10/2007 Wang ..... 439/607
2008/0045085 A1 2/2008 Zhang
2008/0050941 A1 2/2008 Zhang

* cited by examiner

*Primary Examiner*—Edwin A. Leon
*Assistant Examiner*—Vanessa Girardi
(74) *Attorney, Agent, or Firm*—Ming Chieh Chang; Wei Te Chung; Andrew C. Cheng

(57) ABSTRACT

An electrical connector for interconnecting a camera module with a printed circuit board comprises a metal housing including a base wall and side walls extending upwardly from the edge of the base wall. Wherein one of the base wall and the side walls defines a grounding spring extending from the outer surface thereof to ourside. Therefore, when the electrical connector is assembled into a chamber formed on the mobile phone for accommodating the electrical connector, the grounding spring can be compressed between the housing and the inner wall of the chamber, thus, the electricity from the camera module can be transmitted to the mobile phone via the grounding spring and the electrical connector is not interfered by the other electric equipment.

3 Claims, 5 Drawing Sheets

METAL MODULE HOUSING FOR MOUNTING ON A PRINTED CIRCUIT BOARD

CROSS REFERENCE TO RELATED APPLICATION

This application is related to U.S. patent application Filed Date, Jul. 1, 2008, entitled "ELECTRICAL CONNECTOR HAVING A SHIELDED ELEMENT WITH CONDUCTIVITY AND COMPRESSIBILITY".

BACKGROUND OF THE INVENTION

1. Field of the Invention

The present invention relates to an electrical connector, and more particularly to an electrical connector for interconnecting an electronic module such as a camera module for use with a cellular phone or the like to an electrical member such as a printed circuit board. The electrical connector at least has a metal housing, a plurality of spring elements being formed on the outer surface of side walls and a bottom wall of the metal housing so as to realize the grounding function.

2. Description of the Related Art

Conventionally, electronic modules such as a camera module for use with a cellular phone has to be securely maintained in electrical connection with an electronic member such as a printed circuit board. Therefore, a camera socket is dimensioned to securely receive a camera module therein. Consequently, the camera module is electrically connected with the printed circuit board via the shielded connector.

In order to comply with a miniaturization trend of electrical connectors, a flexible printed circuit board is used in said electrical connector to reduce the height of the electrical connector and provide a reliable electric path between a camera module and a printed circuit board.

U.S. Pub No. 2008/0045085, published on Feb. 21, 2008, discloses an electrical connector for interconnecting a camera module and a printed circuit board. Said electrical connector includes a shielded shell and a supporting member attached to the shielded shell. The shielded shell includes a base wall and four side walls commonly defining a receiving space for accommodating a camera module, each side wall extending upwardly from an edge portion of the base wall. Said base wall defines a top surface for attached to the supporting member and a bottom surface opposite to the top surface and adapted for connecting with the printed circuit board. Said side walls comprises a pair of first side walls opposite to each other and a pair of second side walls opposite to each other, wherein each of the first side walls defining a locking finger extending from the inner surface thereof to opposite side wall so as to hold the camera module, each of the second side walls defining a grounding finger extending from the inner surface thereof to the opposite side wall adapted for connecting with the periphery of the camera module. The supporting member includes a main portion attached to the top surface of the shielded shell and a plurality of elastic arms extending from the opposite side edges to outside. When the camera module is inserted into the receiving space of the shielded shell, the elastic arms of the supporting member moves downwardly as the movement of the camera module, and the camera module located into the shielded shell by the elasticity of the supporting member and an electric path between the camera module and printed circuit board is provided.

It is well know that EMI (electro magnetic interference) is a key factor in an electrical connector. If not, the signal between the mobile phone will be interfered by the other electrical component. In order to solve said problem, said electrical connector disclosed by U.S. Pub No. 2008/0045085 includes a grounding finger formed on the shielded shell, therefore, when the electrical connector is assembled on the printed circuit board, the signal of the camera module is transmitted to the printed circuit by the grounding finger against the camera module, therefore, the EMI function has reached. However, it is usually possible that a gap is formed between the shielded connector and the print circuit board, at this moment, the EMI function can be interfered.

Thus, there is a need to provide an improved electrical connector to overcome the above-mentioned problems.

BRIEF SUMMARY OF THE INVENTION

It is an object of the present invention to provide an electrical connector having a shielded element with conductivity and compressibility so as to provides a reliable EMI function.

In order to achieve the objective above, an electrical connector in accordance with an embodiment of the present invention at least includes a metal housing, the housing at least has a base wall and side walls commonly defined a receiving space to accommodate a camera module. The side walls and the base wall define a plurality of spring element extending from the outer surface thereof and away to the receiving space. Thus, then the electrical connector is assembled on the mobile phone, said spring elements are pressed between the electrical connector and the mobile phone, thereby the electrical connector can contact firmly with the mobile phone and the function of grounding and preventing the EMI is realized.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like members in the figures and in which:

DESCRIPTION OF PREFERRED EMBODIMENT OF THE INVENTION

In the following detailed description, for purposes of explanation, numerous specific details are set forth in order to provide a thorough understanding of the present invention.

An electrical connector according to the present invention is applicable to an electronic apparatus such as digital cameras, PDAs (Personal Digital Assistants), PCs (Personal Computers), mobile phones or the like. In the embodiment illustrated in FIGS. 1-5, the electrical connector is used in a mobile handset (not shown) for transferring the signal of a camera module 200 to a printed circuit board (not shown) via a flexible printed circuit board (FPC) 300.

Figure 1:
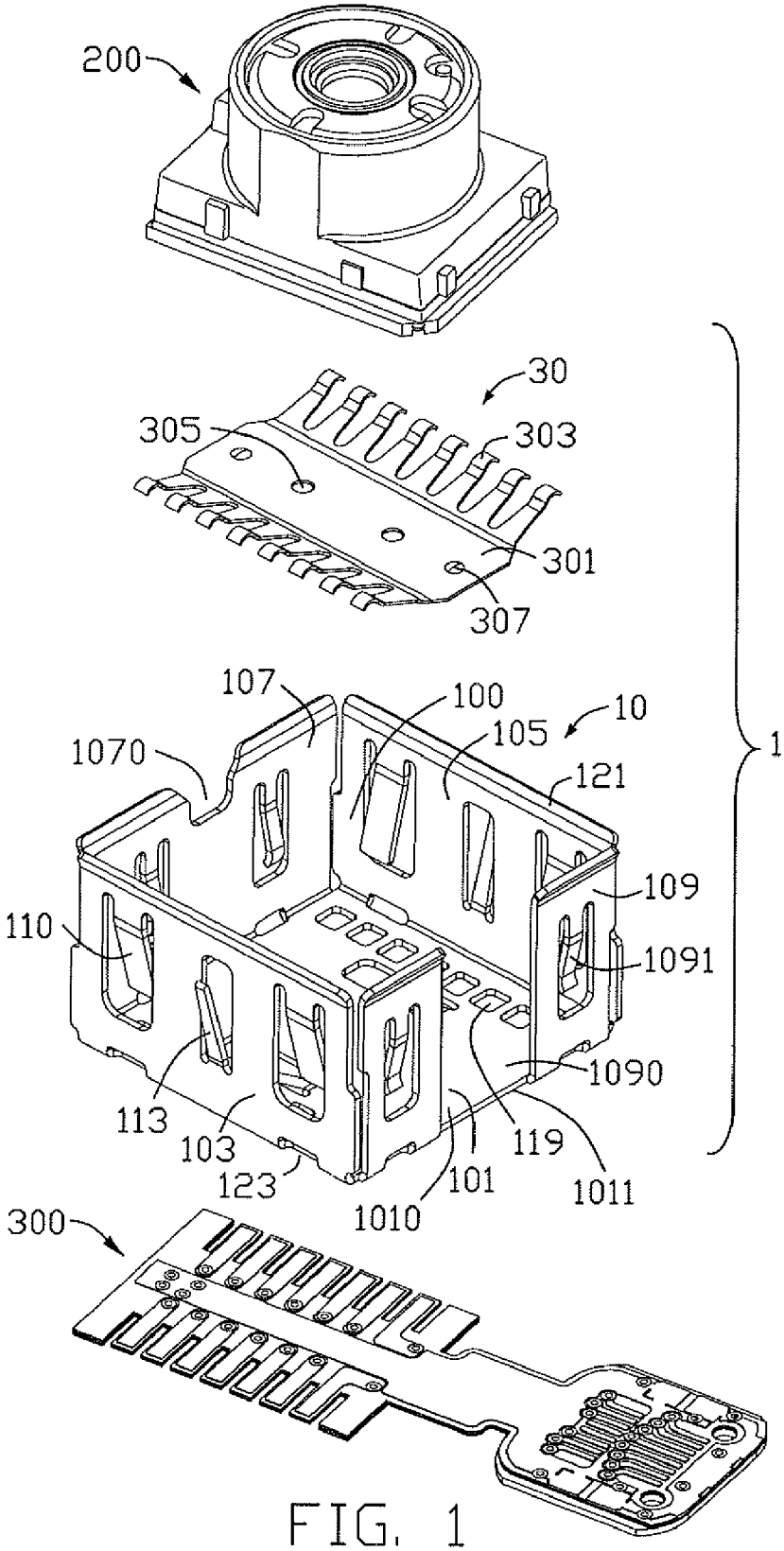
FIG. 1 is an exploded view of the electrical connector according to the embodiment of the present invention, which is assembled with a camera module and a flexible printed circuit board (FPC)
Figure 2:
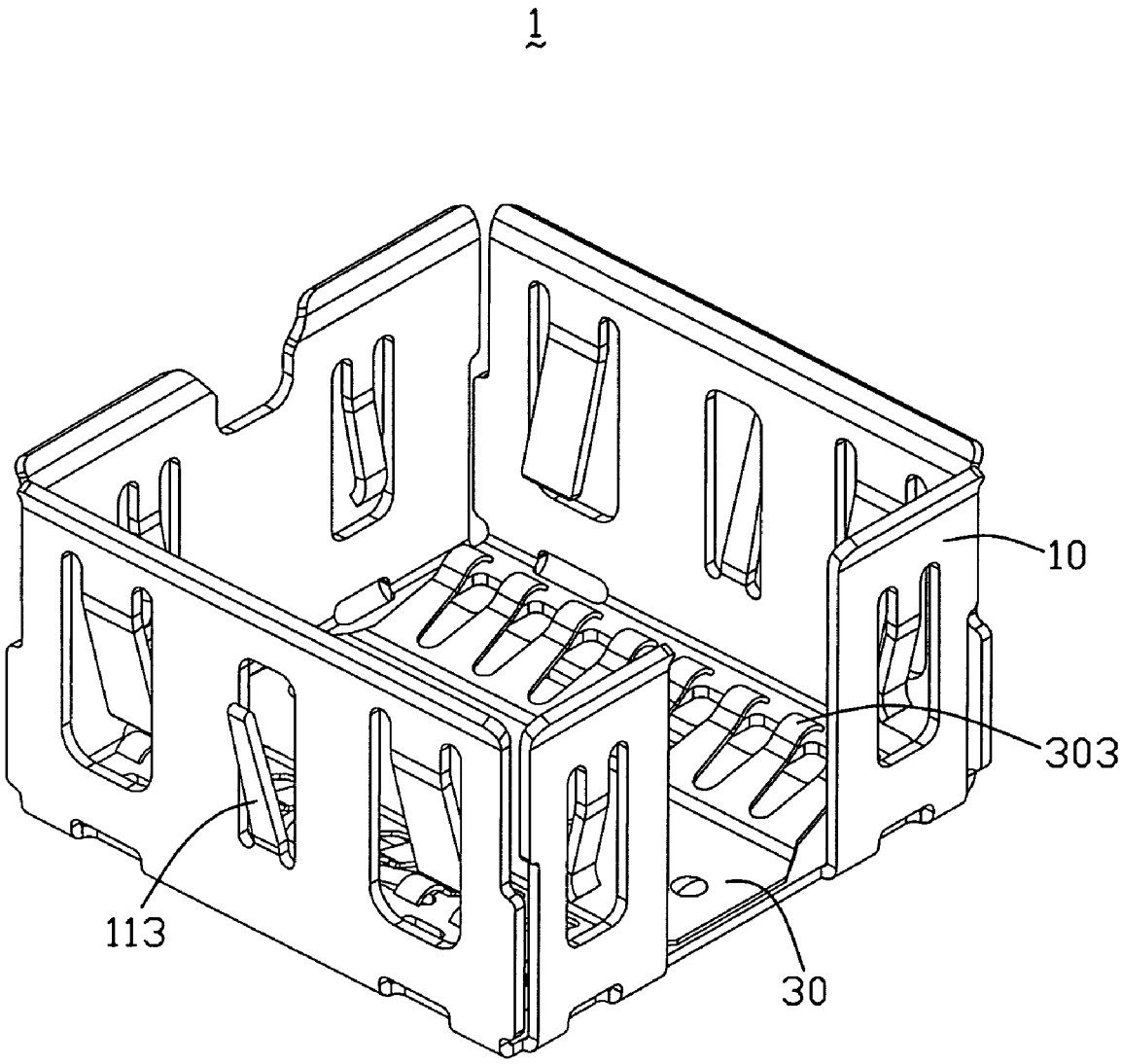
FIG. 2 is a perspective view of the electrical connector according to the embodiment of the present invention.
Figure 3:
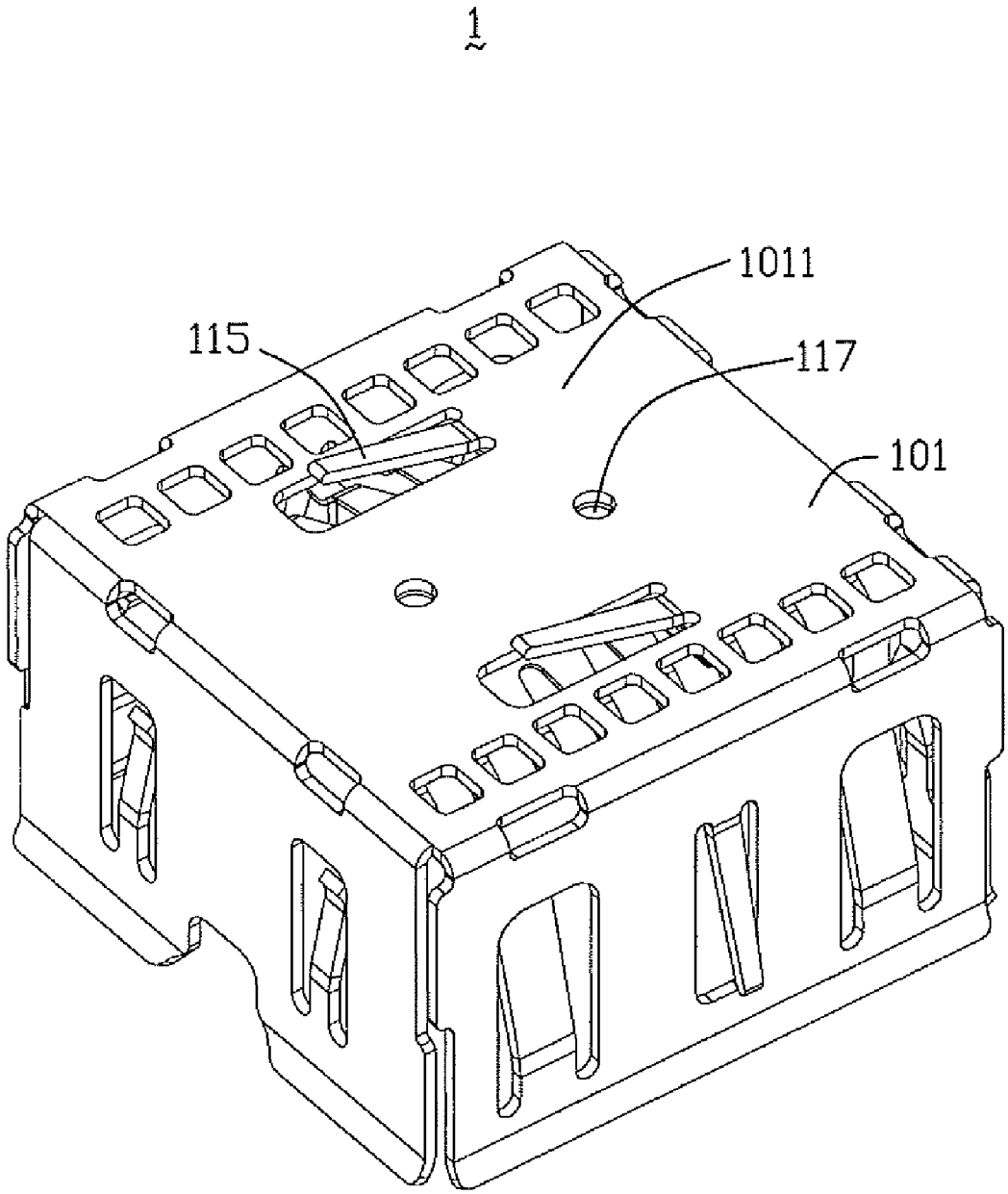
FIG. 3 is another perspective view of the electrical connector according to the embodiment of the present invention.
Figure 4:
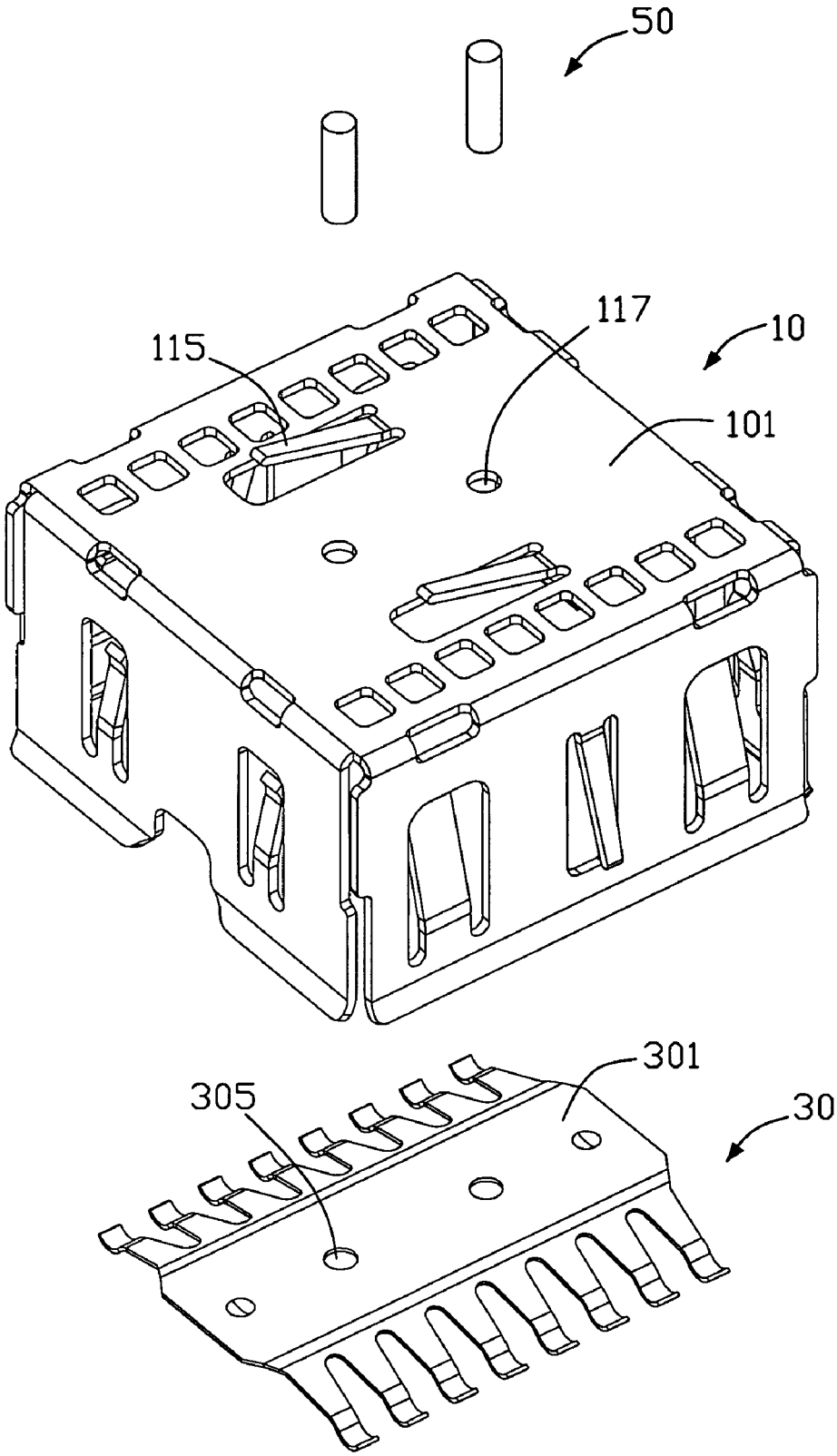
FIG. 4 is an exploded view of the electrical connector in FIG. 3, and the retaining tools is showed together.
Figure 5:
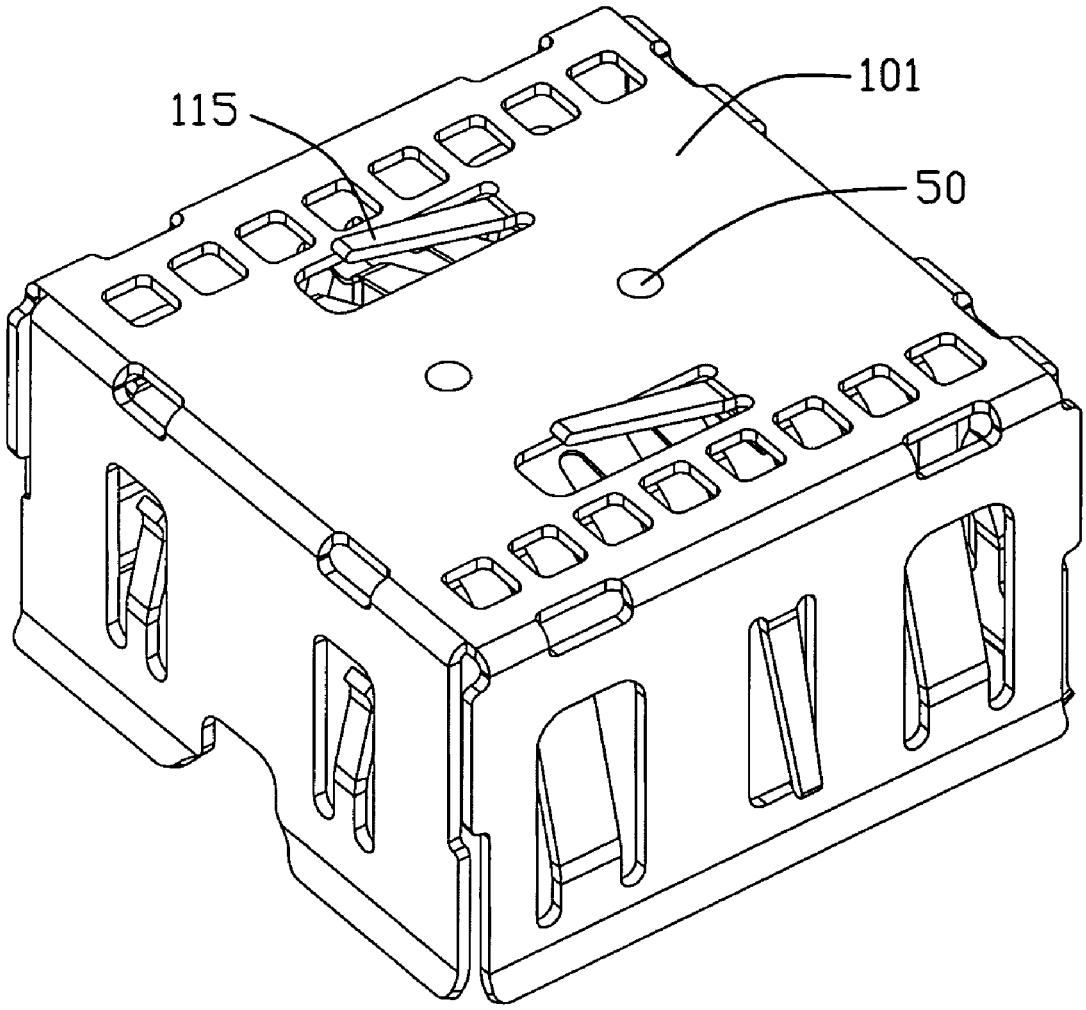
FIG. 5 is a perspective view of the electrical connector in FIG. 4.

FIG. 1 is a perspective view of the electrical connector according to the embodiment of this invention in order to receive a camera module. In the figures, the reference numeral 1 denotes the electrical connector, the reference numeral 10 denotes a housing made of a metal material, and the reference numeral 30 denotes a supporting member attached to the housing.

The housing 10 is made of metal material and configured by front wall 107, rear wall 109, left wall 103, right wall 105 and a base wall 101 cooperatively defining a receiving space 100. Each front wall 107, rear wall 109, left wall 103 and right wall 105 extends upwardly from the peripheral of the base wall 101 and the adjacent walls of the said walls do not connect each other and a slit 123 disposes between the side wall 103, 105, 107, 109, and the base wall 101 so as to improve the elastic property of the housing 10 and retain the camera module (not shown) steadily.

Each of the front and rear wall 107, 109 defines a pair of grounding finger 1091 extending from the inner surface thereof to the opposite walls for contacting with the peripheral wall of the camera module and the end of the grounding finger 1091 smoothly curved inwardly in order to prevent the camera module from being scraped. Further more, the front wall 107 defines a notch 1070 extending downwardly from the top end of the front wall, correspondingly, the rear wall 109 defines a window 1090 penetrating from the top end to the bottom end thereof for providing a path which the printed circuit board passes through.

The left and right wall 103, 105 has the same structure, herein we take the left wall 103 to introduce. Right wall 105 includes a pair of the locking fingers 110 and a first grounding spring 113 disposed between the pair of the locking fingers 110, wherein each locking finger 110 extends from the inner surface thereof to the opposite wall to hold the camera module and the first grounding spring 113 extends from the outsurface thereof to the outside.

The base wall includes a mounting surface 1011 to connect with the printed circuit board and a mating surface 1010 opposite to the mounting surface 1011. A plurality of grooves 119 are formed on the base wall 101 and penetrate through the base wall 101. The grooves 119 arrange as two rows and adjacent to the left and right walls 103, 105 along a direction from the left wall 103 to right wall 105. Moreover, please particular refer to the FIGS. 3-5, the base wall 101 defines a pair of first retaining holes 117 and a pair of second grounding spring 115, wherein the first retaining holes 117 disposes at about middle area thereof and the second grounding spring 115 disposes at the two sides of the first retaining hole 117 and extends from the mounting surface 1011 of the base wall 101 to outside.

The supporting member 30 made of metal material and is a fish-bone shape, including a main portion 301 against with the mating surface of the base wall 101 and a plurality of elastic arms 303 extending from the two side edges of the main portion 301 to outside and disposes above the grooves 119. The main portion 301 includes a bottom surface (not shown) against with the mating surface of the base wall 101 and a top surface (not shown) opposite to the bottom surface. Additionally, the main portion 301 defines a pair of second retaining holes 305 penetrating the main portion 301 and corresponding to the first retaining holes 117, and a pair of protruding portions 307 formed on the top surface of the main portion 301. Said second retaining holes 305 and the protruding portions 307 disposes at a same line and the second retaining holes 305 arrange at middle area and the protruding portions 307 arrange at the two end area.

When assembly, please particular refer to FIGS. 1-5, firstly, a pair of retaining tools 50 pass through the first retaining holes 117 of the housing 10, secondly, the supporting member 30 is attached to the housing 10 by the second retaining holes 305 attaching to the retaining tools 50 and after the supporting member 30 assembled on the housing 10, they are fixed together by spot welding. Finally, the retaining tools 50 are removed. As a result, the housing 10 and the supporting member 30 are fixed together firmly and when the flexible printed circuit board and the camera module put into the housing 10, the position of the supporting member 30 does not move, thereby a well electrical path is provided.

When the flexible printed circuit board and the camera module are assembled into the housing 10, the assembly of the electrical connector 1 is finished and the next step is to put the electrical connector 1 into the mobile phone. As well as we know, the mobile phone (not shown) defines an accept chamber (not shown) to accept the electrical connector 1, therefore, when the electrical connector 1 is put into the accept chamber, the first and second grounding springs 113, 115, contact with the inner surface of the chamber and the electrical connector 1 is hold into the chamber firmly by the elastic force from the grounding springs 113, 115, meanwhile, the presence of the grounding springs 113, 115, provide a grounding function.

In the above description of the preferred embodiment, the metal housing 10 defines a plurality of grounding springs 113, 115, at the base wall 101 and the left and right walls 103, 105, extending from the outer surface thereof to outside, therefore, when the electrical connector 1 is assembled to the mobile phone, the grounding springs 113, 115, can be compressed between the housing 10 and an inner wall of the accept chamber of the mobile phone for accommodating the electrical connector 1. Thus, the base wall and the side wall of the housing 10 can be well contact with the inner wall of the accept chamber of the mobile phone and a grounding function has been well realized.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector assembly comprising:

a metallic shield including a plurality of side walls and a bottom wall commonly defining a module receiving cavity therein;

a supporting plate located upon an upper surface of the bottom wall in said module receiving cavity; and a camera module received in the module receiving cavity to cooperate with the supporting plate to sandwich a flexible printed circuit (FPC) therebetween; wherein at least one of said side walls and said bottom wall includes a unitary grounding spring extending away from the module receiving cavity for engagement with a grounding path in a cell phone; wherein said grounding spring extends downwardly from the bottom wall away from the module receiving cavity.

2. The electrical connector assembly as claimed in claim 1, wherein said grounding spring is stamped from the corresponding opening in said at least one of the side walls and the bottom wall correspondingly.

3. The electrical connector assembly as claimed in claim 1, wherein said supporting plate includes a plurality of elastic arms having contacting ends thereof to press the FPC against the camera module, and the bottom wall defines a plurality of opening in vertical alignment with said contact ends for forgiving thicker camera module.

* * * * *